US006000446A

United States Patent [19]

Wegman et al.

[11] Patent Number: 6,000,446

[45] Date of Patent: Dec. 14, 1999

[54] APPARATUS FOR PARTICULATE PROCESSING

[75] Inventors: Paul M. Wegman, Pittsford; Mikhail Vaynshteyn, Rochester; Charles J. Balistere, Fairport, all of N.Y.

[73] Assignee: Xerox Corporation, Stamford, Conn.

[21] Appl. No.: 09/039,804

[22] Filed: Mar. 16, 1998

[51] Int. Cl.[6] ..... B65B 43/42

[52] U.S. Cl. ..... 141/131; 141/2; 141/18; 141/67; 141/129; 141/172; 141/275; 141/286; 366/194; 366/196; 222/216; 222/220; 222/226

[58] Field of Search ..... 141/2, 10, 18, 141/71–74, 129, 67, 133, 134, 172, 131, 275, 286, 288; 366/111–114, 184, 194, 196; 222/DIG. 1, 185.1, 216, 220, 226, 196

[56] References Cited

U.S. PATENT DOCUMENTS

| | | | |
|---|---|---|---|
| 2,685,986 | 8/1954 | Hampton | 366/184 |
| 3,490,655 | 1/1970 | Ledgett | 366/114 |
| 3,791,558 | 2/1974 | Katusha | 222/161 |
| 4,032,355 | 6/1977 | McLaughlin et al. | 106/273 |
| 4,280,903 | 7/1981 | Scholten | 209/469 |
| 4,505,407 | 3/1985 | Johnson | 222/181 |
| 4,977,428 | 12/1990 | Sakakura et al. | 355/245 |
| 5,095,338 | 3/1992 | Hayes, Jr. et al. | 355/246 |
| 5,327,947 | 7/1994 | McGregor | 141/71 |
| 5,337,794 | 8/1994 | Nishiyama et al. | 141/144 |
| 5,438,396 | 8/1995 | Maedesley | 355/260 |
| 5,727,607 | 3/1998 | Ichikawa et al. | 141/67 |
| 5,823,398 | 10/1998 | Russillo et al. | 222/361 |

*Primary Examiner*—David J. Walczak
*Assistant Examiner*—Timothy L. Maust
*Attorney, Agent, or Firm*—John L. Haack

[57] ABSTRACT

A method including: a particulate material source and receiver, and wherein the source contains a discharge feature; moving material in the source in the direction of a member located at least partially within the source, the member defining an adjustable restriction therein such that the particulate material clogs within the restriction; mechanically agitating the particulate material in the source, at least adjacent to the restriction to thereby unclog the particulate material within the adjustable restriction; and dispensing particulate material through the adjustable restriction, through the discharge feature, and into the receiver.

20 Claims, 7 Drawing Sheets

APPARATUS FOR PARTICULATE PROCESSING

CROSS REFERENCE TO COPENDING APPLICATIONS AND RELATED PATENTS

Attention is directed to commonly owned and assigned U.S. Pat. Nos. 5,685,348, issued Nov. 11, 1997, entitled "ELECTROMAGNETIC FILLER FOR TONER"; and 5,699,842, issued Dec. 23, 1997, entitled "MAGNETIC FILLING AND MIXING APPARATUS AND PROCESSES THEREOF". Attention is directed to commonly assigned copending applications: U.S. Ser. No. 08/829,925, filed Apr. 1, 1997, entitled "OSCILLATING VALVE FOR POWDERS" which discloses a method for filling a powder container with a supply of powder in a vessel, comprising: placing a first powder container to be filled in filling relationship to a discharge feature in the vessel; directing the powder in the vessel toward a member located at least partially within the vessel, the member defining a restriction therein such that the powder clogs within the restriction; mechanically exciting the powder at least adjacent the restriction to improve the flow properties of the powder so as to unclog the powder within the restriction; dispensing powder through the restriction, through the discharge feature and into the first container; stopping the mechanical excitation of the powder so as to clog the restriction with the powder; removing the first container from the vessel; and placing a second container to be filled in filling relationship to the vessel; U.S. Ser. No. 08/823,034 (D/96600), filed Apr. 1, 1997 entitled "TONER VIBRO-CONDITIONING SYSTEM FOR AUGERLESS FILLERS", which discloses a method for filling a powder container, comprising: placing a first powder container to be filled in filling relationship to a supply of powder in a vessel; mechanically exciting the powder in the vessel to improve its flow properties; dispensing powder from the vessel into the first container; removing the first container from the vessel; and placing a second container to be filled in filling relationship to the vessel; and U.S. Ser. No. 08/540,993 (D/95051), filed Oct. 12, 1995, entitled "ELECTROMAGNETIC VALUE AND DEMAGNETIZING CIRCUIT" which discloses a method for controlling filling a container, comprising: placing a first container to be filled in filling relationship to a fill tube; moving a magnetic material from a source thereof through the fill tube to fill the first container with the material; applying a magnetic force to the material in the fill tube once the first container is filled, the magnetic force being sufficient to hold the material in place in the fill tube; removing the first container; placing a second container to be filled in filling relationship to the fill tube; and removing the magnetic force applied to the material so that the material can move through the fill tube and into the second container.

The disclosures of each the above mentioned patents and copending applications are incorporated herein by reference in their entirety. The appropriate components and processes of these patents may be selected for the toners and processes of the present invention in embodiments thereof.

BACKGROUND OF THE INVENTION

This invention relates generally to apparatus and methods for controllably and accurately dispensing particulate materials, and more particularly concerns reliably dispensing particulate materials from a source container to subsequent unit operation process equipment, for example, receiving receptacles on a fill line conveyor such as toner from a supply hopper through a fill tube to a toner container, or a melt mixing or extruder device.

Currently when dispensing powders, for example, toners into toner containers, toner is transported from the toner supply hopper into the container by, for example, a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner friction. High auger speeds will generally cause the toner to melt, particularly for low melt toners, such as disclosed in U.S. Pat. No. 5,227,460 to Mahabadi et al., the relevant portions thereof are incorporated herein by reference.

Toner containers typically have a small opening into which the toner is to be added. Furthermore, the toner containers often have irregular shapes to conform to the allotted space within the copying machine. Therefore it becomes difficult to fill the toner container because of the small tube required to fit into the small toner container opening and secondly for all the toner within the container to completely fill the remote portions of the container before the container overflows.

The problems associated with controlling the filling of toner containers are due primarily to the properties of the toner. Toner is the image-forming material in a developer which when deposited by the field of an electrostatic charge becomes the visible record. There are two different types of developing systems known as one-component and two-component systems. In one-component developing systems, the developer material is toner comprised of particles of magnetic material, usually iron, embedded in a black plastic resin. The iron enables the toner to be magnetically charged. In two-component systems, the developer material is comprised of toner of polymer or resin particles and a colorant, and a carrier of roughly spherical particles or beads usually made of steel. An electrostatic charge between the toner and the carrier bead causes the toner to cling to the carrier in the development process. Control of the flow of these small, abrasive and easily charged particles is very difficult. The one-component and two-component systems utilize toner that is very difficult to flow. This is particularly true of the toner used in two component systems. The toner tends to cake and bridge within the hopper. This limits the flow of toner through the small tubes which are required for addition of the toner through the opening of the toner container. Also, this tendency to cake and bridge may cause air gaps to form in the container resulting in incorrect partial filling of the container.

Attempts to improve the flow of toner have also included the use of an external vibrating device to loosen the toner within the hopper. These vibrators are energy intensive, costly and not entirely effective and consistent. Furthermore, they tend to cause the toner to cloud causing dirt to contaminate the ambient air and to accumulate around the filling operation.

Also, difficulties have occurred in quickly starting and stopping the flow of toner from the hopper when filling the container with toner in a high speed production filling operation. An electromagnetic toner valve has been developed as described in the aforementioned commonly owned and assigned U.S. patent application Ser. No. 08/540,993 and U.S. Pat. No. 5,685,348, the disclosures of which are incorporated herein by reference in their entirety. The electromagnetic valve is limited for use with magnetizable toner such as that described for use with one component development systems.

PRIOR ART

The following disclosures may be of interest to various aspects of the present invention:

U.S. Pat. No. 5,337,794

Patentee: Nishiyama et al.

Issue Date: Aug. 16,1994

U.S. Pat. No. 5,438,396

Patentee: Mawdesley

Issue Date: Aug. 1, 1995

U.S. Pat. No. 5,095,338

Patentee: Hayes, Jr. et al.

Issue Date: Mar. 10,1992

U.S. Pat. No. 4,977,428

Patentee: Sakakura et al.

Issue Date: Dec. 11, 1990

U.S. Pat. No. 4,932,355

Patentee: Neufeld

Issue Date: Jun. 12, 1990

Relevant portions of the foregoing disclosures may be briefly summarized as follows:

U.S. Pat. No. 5,337,794 describes a powder filling apparatus and a method for filling a container with powder. The toner container is filled by conveying toner from a supply hopper through a nozzle with a valve on the end. The valve is disposed at the bottom opening of the nozzle to release and close the opening of the nozzle by the vertical movement of the valve element.

U.S. Pat. No. 5,438,396 is drawn to a toner anti-dribble device which is attached to a toner container having a vertical fill tube and a rotatable auger for feeding toner into a toner container. The toner anti-dribble device also has a sleeve member engagable with the fill tube. A plurality of flexible insertion wires are inserted through the sleeve member into the toner container and disposed substantially perpendicular to the insertion direction of the toner. The arrangement of the wires positively prevents toner dribble between fills while being flexible enough to flex in proportion to the fill rate, which prevents fusing of the toner on the wires.

U.S. Pat. No. 5,095,338 teaches a developer which discharges used carrier particles using a magnetic valve. Discharge of developer material from the developer housing is controlled by a permanent magnet and an electromagnet positioned adjacent an exit port in the developer housing. The permanent magnet generates a magnetic flux field in the region of the exit port to form a developer material curtain which prevents the passage of developer material from the exit port. When the electromagnet is energized, it generates a magnetic flux field which attracts developer material from the developer material curtain. Upon de-energization of the electromagnet, the developer material attracted to it is discharged.

U.S. Pat. No. 4,977,428 discloses an electrographic printer having a pulse motor for driving an agitator. The agitator is built into the developer unit. The agitator is controlled during the initialization process of the apparatus by setting the rotational speed of the motor at a lower level upon startup of the motor. The lower speed results in higher torque to overcome solidification of the toner.

U.S. Pat. No. 4,932,355 discloses a method for removing a developer mix from a developing station with a magnetic closing device which is in the vicinity of a discharge opening in the developing station. In its energized condition, the magnetic closing device creates a magnetic field which acts on the developer mix to form a plug of developer mix in the region of the discharge opening. In the de-energized condition, the magnetic closing device releases the plug of developer mix.

All of the above references are hereby incorporated by reference in their entirety.

SUMMARY OF THE INVENTION

Embodiments of the Present Invention, Include:

Overcoming or minimizing problems encountered in the art by providing particulate handling and filling equipment, which enables improved manufacturing efficiency and material throughput;

A method comprising:

a particulate material source and receiver, and wherein the source contains a discharge feature;

moving material in the source in the direction of a member located at least partially within the source, the member defining an adjustable restriction therein such that the particulate material clogs within the restriction; mechanically agitating the particulate material in the source, at least adjacent to the restriction to thereby unclog the particulate material within the adjustable restriction; and dispensing particulate material through the adjustable restriction, through the discharge feature, and into the receiver;

An apparatus comprising:

a member operably associated with a hopper, the operably associated member defining restrictions therein; and a mechanical agitator for controllably facilitating and blocking the flow of a particulate material through the restrictions; and An apparatus for controlling filling of a container from a hopper containing a supply of powder, the apparatus comprising:

a drive mechanism defining a drive mechanism longitudinal axis thereof for providing reciprocating motion in the direction of the drive mechanism longitudinal axis; and a hollow body defining a body longitudinal axis thereof and suspended from the drive mechanism at an upper end of the body, the body defining an aperture in the periphery thereof, the drive mechanism being selected so as to provide for clogging of the aperture with the powder when the mechanism is disabled and to provide for flow of the powder through the aperture when the drive mechanism is enabled.

These and other aspects are achieved, in embodiments, of the present invention as described and illustrated herein.

BRIEF DESCRIPTION OF THE DRAWINGS

Other features of the present invention will become apparent as the following description proceeds and upon reference to the drawings, in which.

DETAILED DESCRIPTION OF THE INVENTION

Figure 1:
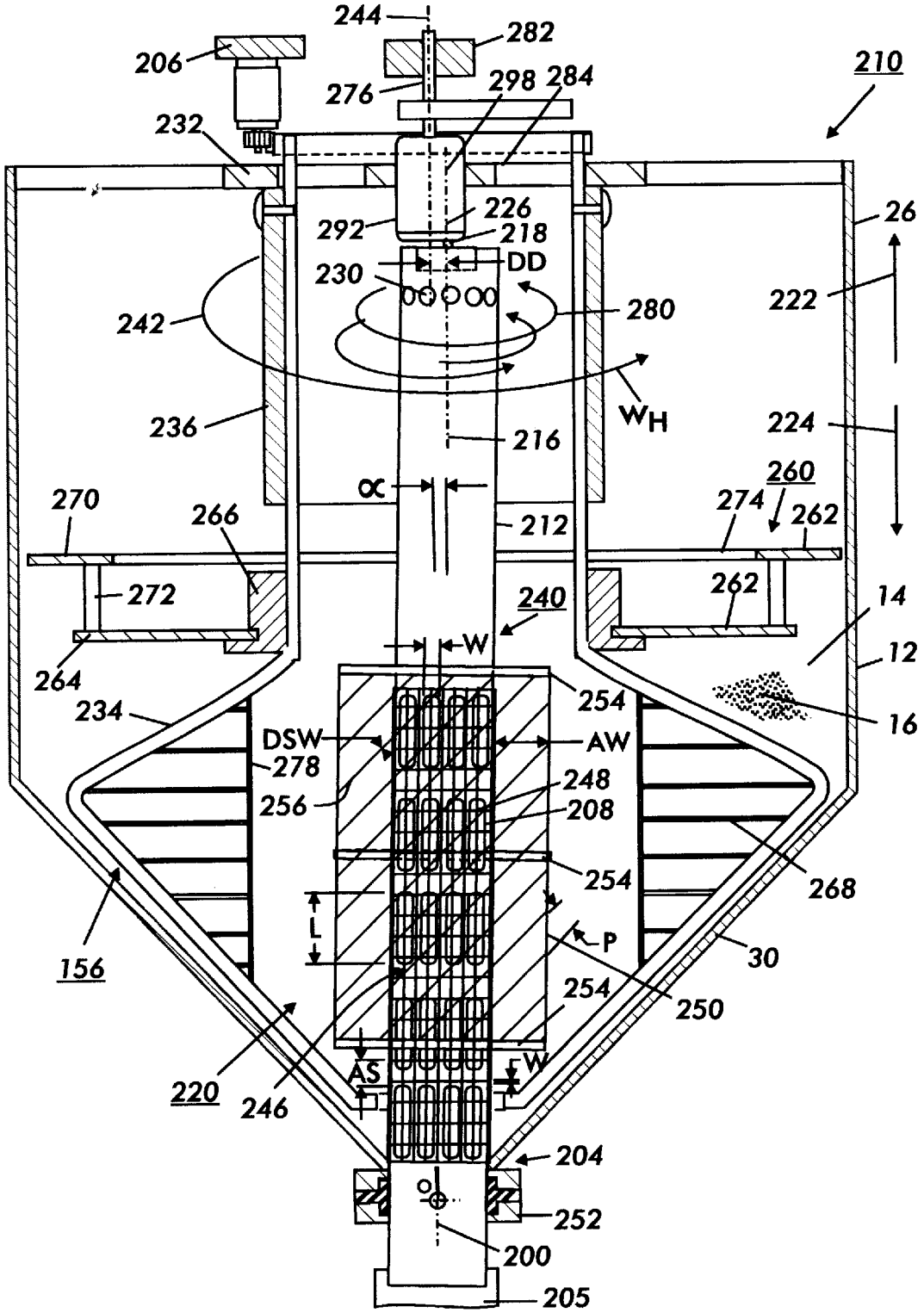
FIG. 1 is a cross-sectional schematic view of an oscillating valve for developer material according to the commonly owned prior art.

While the present invention will be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

In embodiments the present invention provides a method for dispensing particulate material comprising:

providing a source and receiver of particulate material wherein the source and the receiver are placed in filling relationship to a discharge feature in the source;

communicating particulate material in the source toward a member located at least partially within the source, the member defining an adjustable restriction therein such that the particulate material clogs within the restriction;

mechanically agitating the particulate material in the source, at least adjacent to the restriction, to achieve an improved flow property of the particulate material so as to unclog the particulate material within the adjustable restriction;

dispensing particulate material controllably, for example in continuous and discrete feed applications or alternatively in variable feed applications, through the adjustable restriction, through the discharge feature, and into the receiver; and stopping the mechanical agitation of the particulate material so as to clog the restriction with the particulate material.

In embodiments, for example, in continuous and discrete feed applications, the member defining the adjustable restriction can comprise: a tube defining a plurality of apertures in the periphery thereof and a rotatable coaxial tube defining a plurality of apertures in the periphery thereof, and wherein the restriction is of the form of a plurality of variable size apertures arising from varying the relative rotational coaxial relationship of the tube and the coaxial tube.

In embodiments, for example, in variable feed applications, the member defining the adjustable restriction can comprise: a tube or cylinder defining a plurality of apertures in the periphery thereof and a coaxial tube or cylinder free of apertures in the periphery thereof, and wherein the restriction is of the form of a variable number of apertures in the tube arising from varying the relative axial relationship, that is the extent of interpenetration, of the tube and the coaxial tube.

The aforementioned improved flow property is believed to be attributable to achieving highly controlled "liquefaction" or "pseudo liquefaction" phenomena of the particulate material and which phenomena and terms are readily apparent and available to one of ordinary skill in the art of particulate processing and handling.

In aspects thereof the aforementioned method can further comprise removing the receiver from the filling relationship with the source; and replacing with a second receiver in a filling relationship to the source in a continuous or semi-continuous sequence.

The dispensing of the particulate material from the source can be selected to either continuous or variable, for example, for use in toner or developer filling and packaging operations, where it is preferred to dispense and fill by weight or gravimetrically.

Alternatively, the dispensing of the particulate material from the source can be selected to be both continuous and discrete, for example, for use in toner extrusion or melt mixing applications, and wherein the aforementioned restriction fixes the size of the openings in the discharge feature.

The continuous and discrete feeding from vibro dispensers as illustrated herein can provide a substantially more uniform material feed thus reducing undesired variability compared to conventional auger feeders which typically feed in clumps, and provide an increase in output efficiency from about 200 to about 400 percent compared with a conventional auger filler with the same output diameter.

In fill or dispense operations of the present invention the receiver can be conveniently brought into the filling relationship with the source, for example, via a conveyor and elevator.

Although not wanting to be limited by theory it is believed that the highly reliable operation of the method and apparatus of the present invention is afforded by the controllable discharge and retention of particulate materials which is achieved by agitating the particulate material and thereby providing a void volume of air between particles which is substantially constant in the source discharge feature of from about 12 to about 15 percent of the total volume.

The present invention is applicable to many particulate feed, discharge, and fill operations, for example, toner fill operations and reliably combining toner constituents in for example, pre-extrusion and extrusion operations. Thus, the receiver member can be selected from, for example, an extruder, a melt mixing device, a classifier, a blender, a screener, a variable rate toner filler, a bottle, a cartridge, a container for particulate toner or developer materials, and the like static or dynamic particulate receptacles.

The step of mechanically agitating the particulate material comprises, for example, subjecting the particulate material in the source to a vibration source with a frequency of from about 10 Hertz to about 200 Hertz, and to an acceleration source for accelerating the particulate material to about 32.2 to about 64.4 feet/sec$^2$ in the vertical direction. The acceleration to the powder in a upwardly direction can increase the volume of the powder by at least 10 percent and in embodiments for about 10 to 100 percent, that is, displacing powder in a direction substantially opposed to the flow of powder into the container increases the bulk void volume and particulate liquefaction and thereby enables highly controllable, high efficiency particulate discharge, and valving of the particulate material.

Directing the particulate material in the present invention can include directing the particulate material through a tube located at least partially within the vessel, and alternatively, dispensing the particulate material from outside the tube through apertures in the tube into the interior of the tube.

Also, the present invention provides an apparatus for controlling filling of a container from a hopper containing a supply of powder, comprising: a member operably associated with the hopper, the member defining a restriction therein; and a mechanical agitator for controllably facilitating and blocking the flow of powder through the restriction. The mechanical agitator provides an acceleration to the powder in a upward direction so as to increase the total volume of the bulk powder and increase the void volume by from about 10 to about 100 percent. The mechanical agitator can provide an acceleration source for accelerating the powder to about 32.2 to about 64.4 feet/sec$^2$, wherein the mechanical agitator subjects the powder to a vibration source with a frequency of, for example, from about 10 Hertz to about 200 Hertz. The member operably associated with the hopper can comprise a tube, the restriction being in the form of an aperture, or a plurality of apertures, in the periphery of the tube.

The present invention provides an apparatus for controlling filling of a container from a hopper containing a supply of powder or similar particulate material, the apparatus comprising:

a drive mechanism defining a drive mechanism longitudinal axis thereof for providing reciprocating motion in the direction of the drive mechanism longitudinal axis; and a hollow body defining a body longitudinal axis thereof and suspended from the drive mechanism at an upper end of the body, the body defining an aperture or plurality of apertures in the periphery thereof, the drive mechanism being selected so as to provide for clogging of the aperture(s) with the powder when the mechanism is disabled and to provide for flow of the powder through the aperture(s) when the drive mechanism is enabled. The drive mechanism can provide an acceleration to the powder in a upward direction so as to increase the volume of the powder by from about 10 to about 100 percent. The aforementioned apparatus can further comprise an agitator for assisting the flow of powder from the hopper toward the aperture, the agitator including a body rotatably connected to the hopper. The body can comprise a cylinder or tube defining a solid cylinder, or alternatively, a plurality of apertures in the periphery thereof.

According to the present invention, and referring to FIG. 1, the powder dispenser 210 with the oscillating toner valve 240 to be discussed is shown. A hopper 12 with a supply of toner 16 contains an oscillating valve 240 aligned with the toner container to be filled 205.

The oscillating valve 240 serves to "liquefy" and control the flow of powders such as xerographic toners. It should be appreciated that the invention is equally well suited for any powder or particulate material, for example cement, flour, cocoa, herbicides, pesticides, pharmaceuticals, and the like materials. When the volume of a given mass of toner is forced to oscillate in vertical direction, the volume of the toner increases by from about 12 to about 15 percent, and the friction between toner particles is reduced by approximately a factor of 40. The additional volume for the particular mass of toner is comprised of air. The air penetration between the particles decreases the friction between the particles. This reduced friction causes the transition of the toner from a powder state to a liquid-like state, for example, the toner flows as though it was a liquid such as water.

FIG. 1 depicts an embodiment of a device that is capable of increasing the volume of the toner to improve its flow properties. This increase in volume to cause the dramatic improvement, for example, by a factor of 40, of the known liquefaction characteristic of the toner flow.

Increasing the volume of toner from about 12 to about 15 percent requires that the toner particles be accelerated in a direction opposed to that of the gravitational pull. The toner must thus be accelerated a upwardly direction. An acceleration of approximately between one to two times the acceleration of gravity is sufficient to permit the liquefaction of toner. Subjecting the toner particles to a cyclic or reciprocating force which has a frequency with a range of 20 Hertz to 70 Hertz is effective in creating the liquefaction of the toner. A frequency of 50 Hertz is particularly effective in creating liquefaction. When subjecting the toner to a cyclic or reciprocating force, the amplitude of the acceleration is preferably in excess of approximately 1 millimeter. Referring again to FIG. 1, a powder dispenser 210 with the oscillating toner valve 240 is shown. The powder dispenser 210 includes a hopper 12 including a chamber 14 within the hopper 12 for storing a supply of toner 16. The hopper 12 may be made of any suitable, durable material which is chemically non-reactive with the toner 16, for example stainless steel. An accelerating device 220 is located at least partially within the chamber 14. The accelerating device 220 is utilized to accelerate the toner 16 in a direction of arrow 222 opposed to direction 224 of gravity. It should be appreciated that the accelerating device 220 may be any device capable of accelerating the particles into the direction of arrow 222 with an acceleration of between approximately one and two times the acceleration of gravity (1 to 2 G's) or 32–64 feet per second square. The accelerating device 220 as shown in FIG. 1 is positioned in the hopper 12. The hopper 12 may have any suitable shape. For example, as shown in FIG. 1, the hopper may have an upper portion 26 with a generally cylindrical shape and a lower portion 30 with a conical shape. Referring again to FIG. 1, an oscillating valve 240 is positioned at least partially within hopper 12. The hopper 12 includes a chamber 14 for storing a quanity of toner 16. It should be appreciated that the oscillating valve 240 includes any device which causes a localized liquefaction of toner. The toner is guided to that localized area and is caused to be liquefied by exciting the toner and caused to stop flowing or be clogged by stopping the excitation of the toner. The oscillating valve 240 includes an acceleration device 220 for accelerating the toner in an upward direction with sufficient acceleration to increase the volume of the toner and thereby cause the toner to be liquefied. Preferably, as shown in FIG. 1, the acceleration device 220 includes a tube 240. The tube 240 extends downwardly to hopper opening 204 in lower portion 30 of hopper 12. The tube 240 includes at least one aperture 208 in the periphery 212 thereof. While the tube 240 may operate with only a single aperture 208, preferably, the tube 240 includes a plurality of equally spaced apertures 208 through the periphery 212 of the tube 240. The tube 240 may be supported within the hopper 12 in any suitable fashion for example, as shown in FIG. 1, the tube 240 is supported by eccentric bushing 292 in the upper portion of the hopper 12 and is sealed at flange 252 mounted to hopper 12. As shown in FIG. 1, preferably, the tube 240 includes apertures 208 in the form of elongated slots extending in a vertical direction parallel to tube axis 216. The slots 208 have a length L and a width W. The dimensions for length L and width W depend on the type of powder dispensed, the amplitude of the vibrations of the oscillating valve and the desired flow. As shown in FIG. 1, the apertures are equally spaced around tube 240. The apertures 208 may be located on several rows. As shown in FIG. 1, there are five rows of apertures 208. The tubing 240 is caused to pivot and oscillate about flange 252. This may be accomplished in any suitable fashion. For example, as shown in FIG. 1, the tube 240 is supported on its upper end by a stem 218. The stem 218 may extend upwardly from the upper end of tube 240. An eccentric bushing 292 extends downwardly from shaft 276. The bushing is connected to the shaft 276 and rotates therewith about shaft axis 244. Shaft 276 rotates by any suitable manner, for example, by shaft motor 207 (see FIG. 2). The shaft 276 is supported by bearings 282 and 284. The shaft rotates in direction of arrow 280 at a rotational speed ($\omega S$ of approximately 3,000 revolutions per minute. The bushing 292 includes an offset bore 226 having a centerline 298 offset from the shaft centerline 244 a distance DD. The stem 218 is rotatably fitted into the offset bore 226. As the eccentric bushing 292 rotates with the shaft 276 at rotational speed $\omega S$ of 3,000 RPM the stem 218 orbits about the eccentric bushing centerline 244 at a frequency of 3,000 cycles per minute or 50 cycles per second or 50 Hertz. To minimize vibrations of the acceleration device 220, the shaft 276 and bushing 292 are dynamically balanced. While the upper end of the tube orbits about centerline 244, the lower end of tube 240 pivots about vertical centerline 200 of flange 252. The amplitude of the oscillation of the tube 240 at any point in the mechanism in the vertical direction may be defined by formula: $Ai=Ri \tan \alpha$ where: Ai is the amplitude of the oscillation in the vertical direction at any point of the mechanism Ri is the horizontal distance from the shaft axis 244 to that point in the mechanism. $\alpha$ is the angle between axis 216 and axis 244 with the root at the point O. Further, the acceleration of the oscillations in the vertical direction which creates the effect of liquefaction may be defined by the formula: $Am=-Ai\omega 2 \tan \alpha$ where: Am is the acceleration of the oscillations in the vertical direction; Ai is the amplitude of the oscillations in the vertical direction; $\omega$ is the angular rotation speed 280 of the shaft 276. With rotation of the eccentric bushing 292, the upper section of the tube 240 performs nutation with the frequency equal to the number of revolutions of the shaft 276. The toner adjacent the tube 240 is greatly influenced by the vibration. Influenced by this vibration, the toner 16 near pipe 240 is vibro-liquefied and flows through the apertures 208 in the periphery 212 of the tube 240 into the inside of tube 240. By the force of gravity, the toner freely falls through the interior of the tube 240. The toner falls directly into a toner cartridge. When the toner is dispensed directly from tube 240 into the toner cartridge, care must be taken to avoid having toner dust contaminate the filling line.

Preferably, the tube 240 includes decompression or venting perforations or holes 230 through the periphery 214 of the tube 240 near the upper end of tube 240. The decompression perforations 230 serve to provide air access inside the tube 240 to allow free access of air through the interior of tube 240 to permit the toner 16 to freely fall within the tube 240. To prevent the clogging of the perforations 230 by the toner 16, preferably a protective cap 236 in the form of a sleeve is position around the tube at the perforations 230. When the shaft motor 207 (see FIG. 2) is stopped, the nutation of the tube 240 stops and the liquefaction of the toner at apertures 208 stops. The toner 16 bridges over the apertures 208 and the flow stops. Dispensing of the toner 16 thus can be controlled simply by starting and stopping the shaft motor 207.

While the system as described above will provide for the liquefaction of toner and improve flow of toner, the dispensing of the toner may not be closely controlled. Preferably, therefore, additional structure has been discovered which improves the control of the toner flow. For example, as shown in FIG. 1, first grid 246 is used to increase the uniformity of toner flow into the tube 240 at the apertures 208. The first grid 246 may be made of any suitable durable material which is chemically non-reactive with toner 16 and which assists in regulating the flow of toner. For example, the grid 246 may be made of a series of first grid wires 248. The wires 248 may for example be made of stainless steel. The first grid wires 248 have a wire diameter WR, of perhaps 0.05 inches, preferably, located over periphery 212 of tube 240 at least adjacent the apertures 208. The first grid wires 248 may be placed in any reasonable pattern. As shown in FIG. 1, the wires are spaced circumferentially on the periphery of tube 240. The wires 248 are preferably spaced apart a distance AS from each other, for example 0.5 inches.

The flow rate may be uniformly controlled with the use of first grid 246, Preferably, however, the acceleration device 220 further includes a second grid 250. The second grid 250 may have any suitable configuration capable of improving the flow rate uniformity. For example, as shown in FIG. 1, the second grid 250 includes a series of second grid wires 256 spaced a distance AW from the periphery 212 of the tube 240. The second grid wires 256 are supported by any suitable method around the tube 240. For example, the wires 256 are supported by rings 254 extending outwardly from the periphery 212 and secured thereto. The wires 256 are secured to ring 254 in any suitable manner, but, preferably, as shown in FIG. 1, the wires 256 are uniformly positioned around ring 256 a distance P from each other. The wire 256 are preferably horizontally oriented, but are shown diagonally in FIG. 6 for clarity. The second grid 250 is preferably positioned around the apertures 208 to improve the uniformity of the flow of toner 16 into the apertures and thereby increasing the flow through the apertures.

Since the oscillating valve 240 of FIG. 1 causes the toner 16 to liquefy, that is, to change from conventional solid particulate flow characteristics to liquefied particulate flow characteristics, in localized areas adjacent the apertures 208, it was found that the toner flows rapidly adjacent the apertures 208 and has a tendency to "rat hole" or have cavities spaced from the apertures and which rat holes stop the progressing of the vibrations within the acceleration device 220, thereby inhibiting the liquefaction process around the apertures 208. The rat holes tend to provide an air gap between the liquefied toner adjacent the apertures and the remaining toner within the hopper 12. An agitator 156 is therefore utilized to advance the toner 16 within hopper 12 toward the apertures 208.

The agitator 156 may have any structure and may be made of any materials suitable for transferring the toner 16 toward apertures 208. For example, the agitator 156 may include an agitator blade 234. To balance the forces within agitator 156, preferably, the agitator 156 includes two opposed blades 234. The blades 234 are supported in any suitable fashion.

For example, the blades 234 are connected by circular disk 266. Wire braces 268 and 278 help to mix and move the toner toward the tube 240. The agitator 156 preferably rotates around tube 240. The agitator 156 is supported at its upper end by upper bearing 232. Bearing 232 is mounted to hopper 12. Thus, the agitator 156 rotates about shaft axis 244.

To reduce the impact of hydrostatic pressure on the upper layer of toner, applicants have found that the addition of features in the form of rings are helpful. Preferably, the agitator 156 includes bottom ring 264 extending from disk 266. Bottom ring 264 is fixedly secured to agitator 156 and rotates therewith. Preferably, a top ring 270 is positioned spaced from and above bottom ring 264 and is supported by braces 272 and spokes 274. Top ring 270 also rotates with agitator 156. The agitator 156 is caused to rotate in any suitable fashion, for example, by agitator motor 206. The agitator 156 rotates in the direction of arrow 242 and a rotational speed ωH of approximately 3 to 45 revolutions per minute.

The component of the acceleration of the acceleration device 220 in the direction of arrow 222 opposed to the direction of gravity as shown in arrow 224 is responsible for the liquefaction of the toner. A device for accelerating toner is most efficient, therefore, when moving toner substantially in the direction of arrow 222. Thus, a vibratory valve which has an acceleration device which moves in the direction of arrow 222 exclusively would be preferred.

Figure 2:
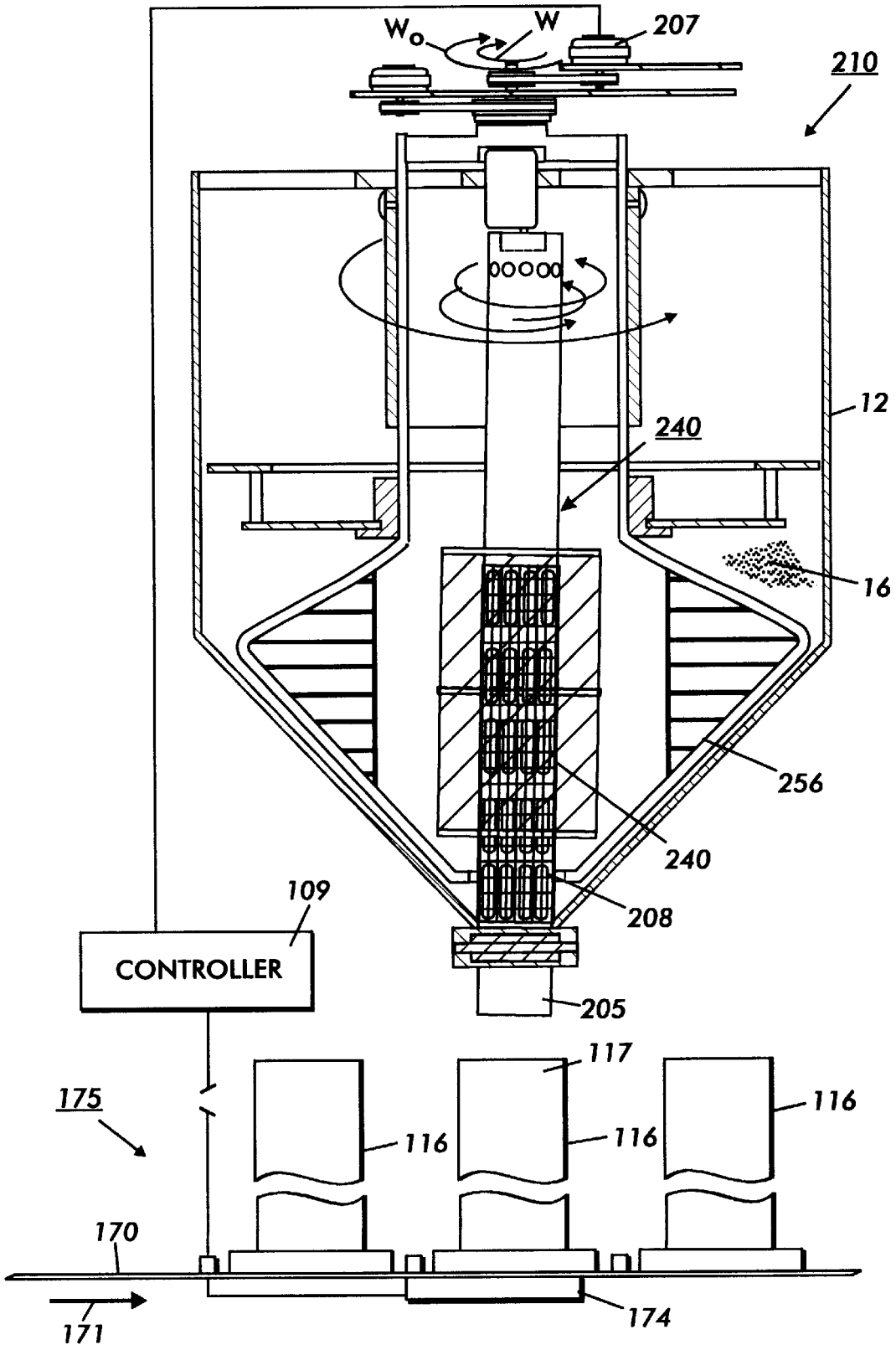
FIG. 2 is a side view of a container filling system partially in section for use with the vibratory filler for developer material of FIG. 1 after the container is filled.

Referring to FIG. 2, the oscillating valve 240 is shown installed in the hopper 12 and positioned over an automatic high speed production filling line 175. A conveyor 170 advances a container 116 to be filled in the direction of arrow 171 to a position with the toner opening 117 of the container 116 directly below fill tube 205. A lifting mechanism 174 raises the container 116 into engagement with the fill tube 205. The agitator 256 advances toner 16 toward valve tube 240. When a container 116 is to be filled, a controller 109 signals the oscillating motor 207 to be energized. The motor 207 causes the tube to oscillate permitting the toner to pass through apertures 208. The toner 16 advances into container 116 and fills the container. The lifting mechanism 174 then lowers the container 116 and the conveyor 170 advances another container 116 into filling position. It should be appreciated that, alternatively, depending on the size of the container opening, the toner may be dispensed directly from the fill tube 205 into the container opening. The direct dispensing of the toner from the valve into the container would obviate the need for a lifting mechanism and permit more rapid filling. A filling process that has clearance between the valve and the container would require suitable dust control.

Figure 3:
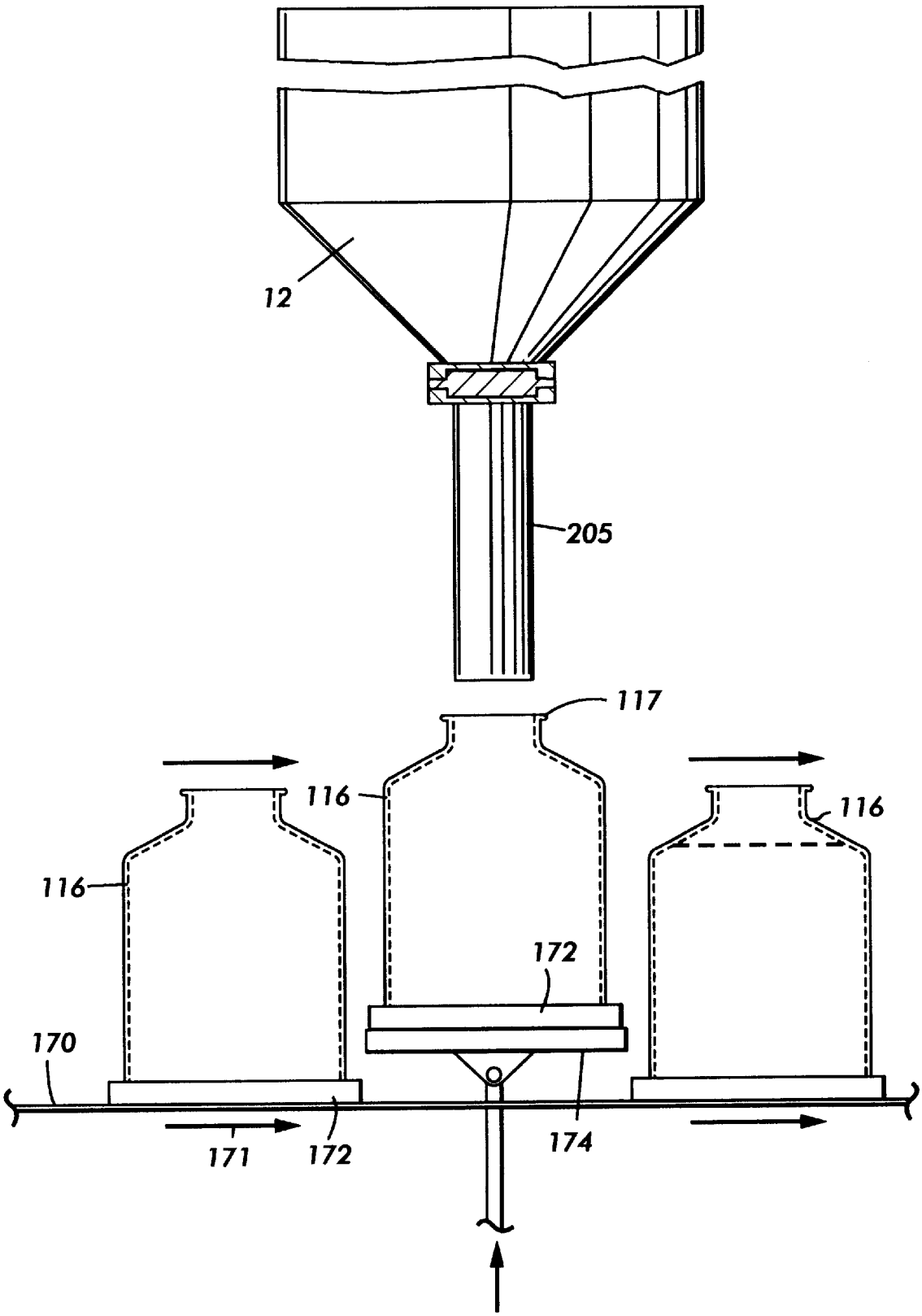
FIG. 3 is a side view of the container filling system for use with the vibratory filler for developer material of FIG. 1 prior to filling the container.

FIG. 3 depicts a side view of moving containers 116 along an indexing conveyor 170 relative to the fill tube 205, which is relevant to all of the embodiments. Each of the containers is positioned in a carrying device 172, also known as a puck. Each puck is specially designed and built for each type of toner container, the puck allowing for different container widths and heights. A puck is used so that the same conveying and lifting system can be used with varying toner container types. When the container is in position under the fill tube the lifting mechanism 174 pushes the puck with the container in it up until the lifting mechanism is fully extended. When the lifting mechanism is fully extended, the container is in the proper filling relationship with the fill tube. It should be appreciated that the container may be placed on a conveyor without a puck, particularly if the filling line is a dedicated line and if the container has a self-supporting shape that would not to permit the container to easily tip.

Figure 4:
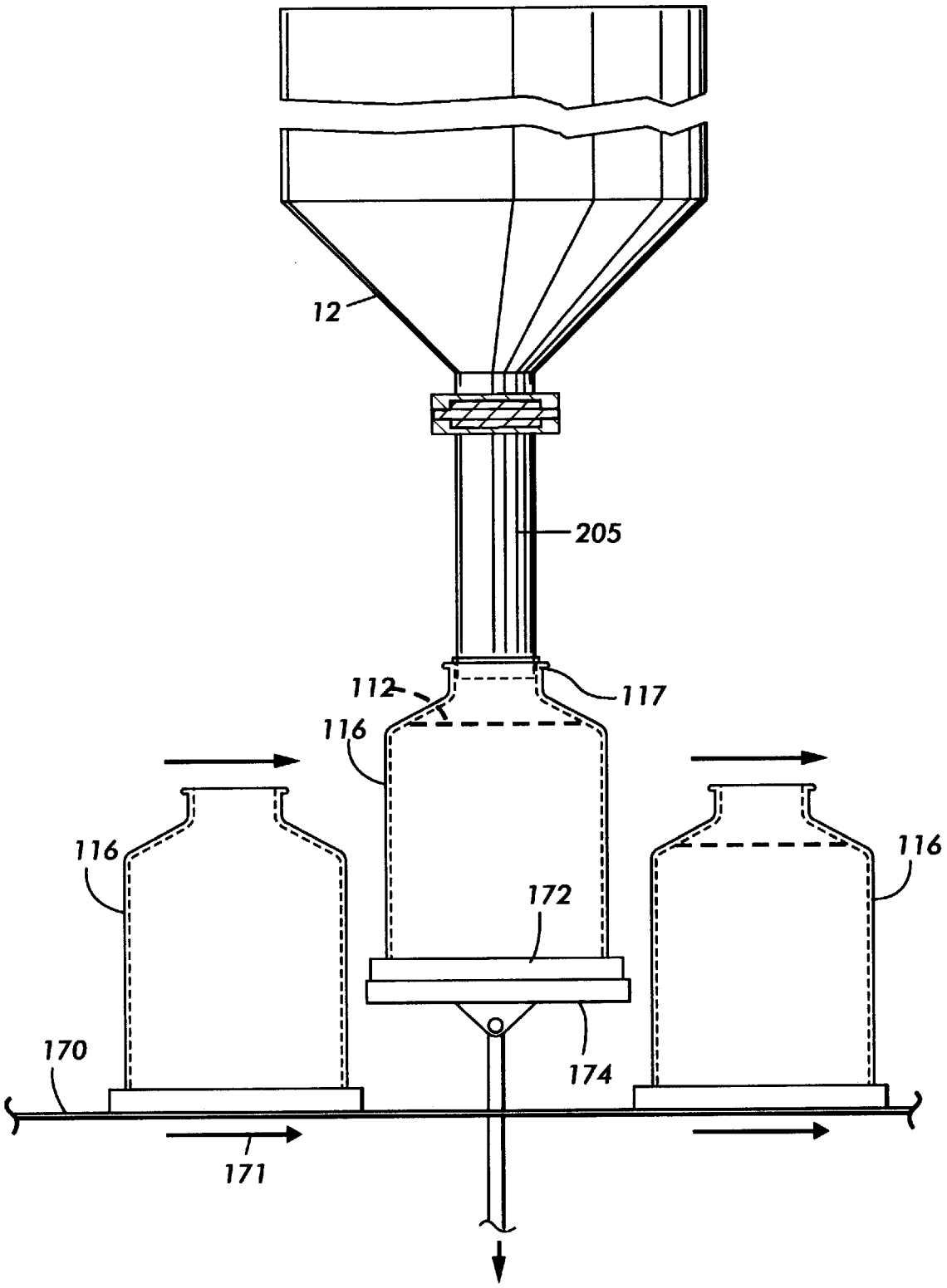
FIG. 4 is a side view of the container filling system for use with the vibratory filler for developer material of FIG. 1 subsequent to filling the container.

FIG. 4 shows the container in the proper filling relationship to the fill tube, the container opening 117 receiving the end of the fill tube 205. The amount of toner loaded in the container is predetermined based on the size of the container and the toner flow is controlled by a particular number of cycles of the oscillating vibratory filler. Once the predetermined amount of toner passes through the fill tube for a particular number of cycles of the oscillating vibratory filler the container is filled and the filling process is stopped so that the container may be moved from under the fill tube.

Figure 5:
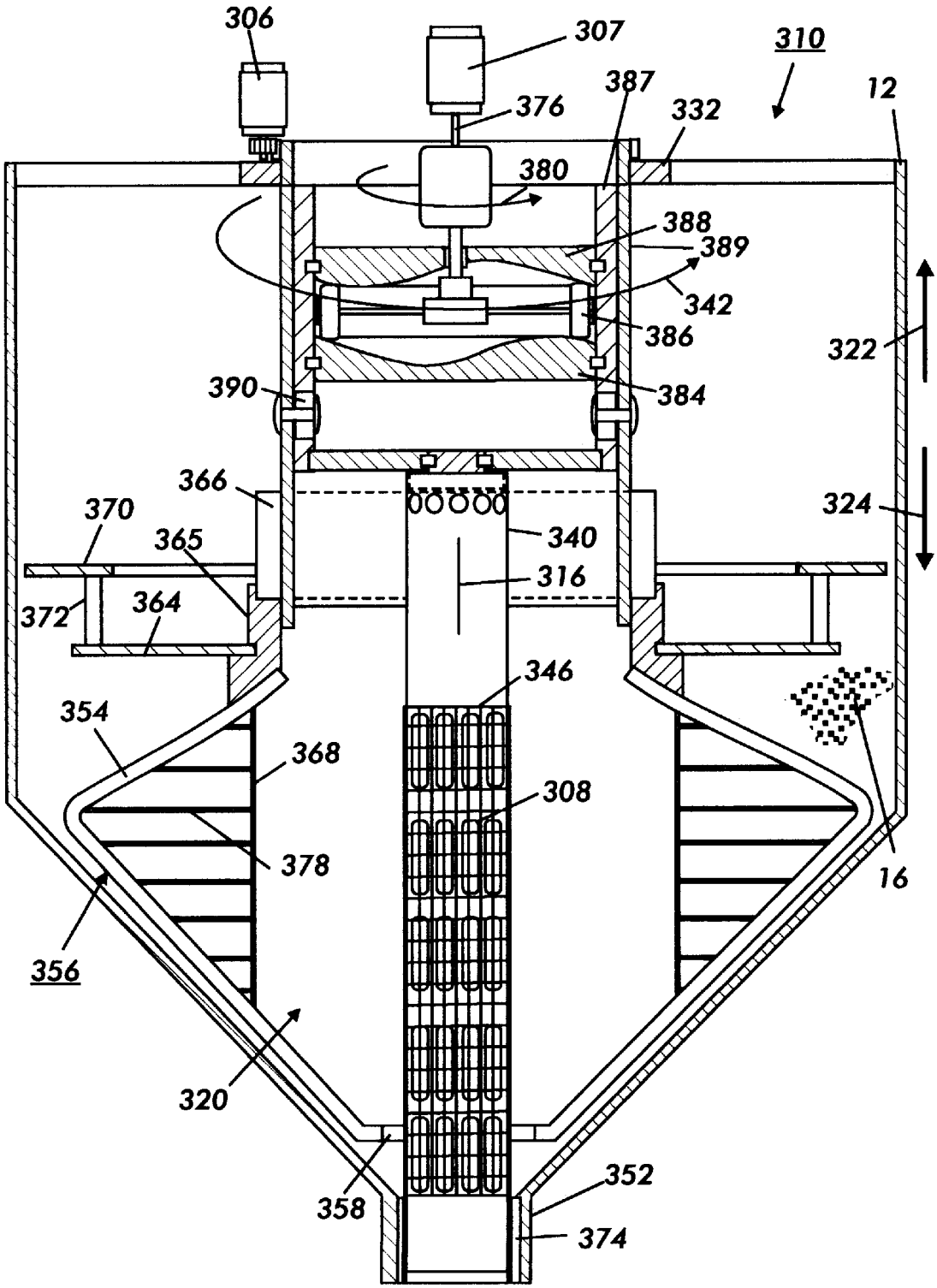
FIG. 5 is a cross-sectional schematic view of an embodiment of the oscillating valve for developer according to the commonly owned prior art.

Referring to FIG. 5, vibratory toner dispenser 310 is shown. Valve 340 is similar to valve 240 except that tube 340 moves exclusively in the direction of arrows 322 and 324, reciprocating therebetween. The vibratory powder dispenser 310 is similar to powder dispenser 210 of FIG. 1. Powder dispenser 310 includes an acceleration device 320 which is similar to acceleration device 220 of FIG. 1 except that the tube 340 unlike tube 240 of FIG. 1 moves primarily and preferably exclusively in a direction parallel to centerline axis 316. Tube 340 thus moves upwardly in direction of arrow 322 and downwardly in direction of arrow 324.

Any suitable method may be used for oscillating the tube 340. For example as shown in FIG. 5, the tube 340 is rigidly connected to cams 384 and 388. Rollers 386 are between lower cam 384 and upper cam 388 and when rotated force the tube to oscillate. Rollers 386 are rotated by auger shaft 376. The auger shaft 376 may be rotated in the direction of arrow 380 at a rotational speed ωS of approximately 4,500 revolutions per minute by any suitable device, for example, by shaft motor 307.

As the auger shaft 376 rotates, the rollers likewise rotate in the horizontal plane and cause the cams 384 and 388 which are fixedly secured to cam support 387 to move upwardly and downwardly. The cams 384 and 388 are fixedly connected to tube 340 by cam support 387. Cam support 387 slides upward and downwardly within agitator shaft 389 within the slots 390. The cams 384 and 388 cause tube 340 to oscillate upward and downwardly in the direction of arrows 322 and 324. The tube 340 protrudes through the hopper 12 at lower bushings 374 which is secured to tube flange 352 and is secured to the cam containing system.

The tube 340 preferably includes apertures 308 located in the tube walls. The apertures 308 are similar to apertures 208 of FIG. 1. Toner is caused to progress through apertures 308 when the tube 340 is caused to oscillate. The toner is caused to clog in the aperture 308 when the auger shaft 376 does not rotate. To assist in controlling the flow of toner, the apertures 308, preferably, a grid 346 similar to grid 246 of FIG. 1 is applied over the tube 340 at least adjacent the apertures 308. While the tube 340 as shown includes only first grid 346, it should be appreciated that the tube 340 may also include a second grid (not shown) spaced from first grid 346, which may be similar to second grid 250 of FIG. 1.

As shown in FIG. 5, the tube is caused to oscillate in the direction of tube axis 316 by an auger shaft and cam mechanism. It should be appreciated that any other mechanism capable of oscillating the tube will be sufficient. For example, the tube 340 may be oscillated by an electromechanical or hydraulic vibrator.

The tube 340 may oscillate at any frequency but, preferably oscillates at a frequency of approximately 10 to 200 Hertz with about 69 Hertz being preferred.

The tube 340 oscillates in the direction of tube axis 316 in upward direction 322 and downward direction 324 with an amplitude DH of approximately between about 0.06 and about 0.12 inches. The amplitude and frequency of the oscillations effects the acceleration of the particles and the ability of the toner to become liquefied.

The acceleration of the oscillations in the vertical direction at any point on the tube which creates the effect of liquefaction may be defined by the formula: $Am=2L/t^2$(time square) where: Am is the maximum acceleration of the oscillations in the vertical direction; L is the amplitude of the oscillations, t is time equal one quarter of the duration of one full cycle of oscillation called "period of oscillation"-T. As with the valve 240, the valve 340 preferably includes an agitator 356 similar to agitator 156 of FIG. 1. The agitator 356 serves to move the toner particles toward the apertures 308.

The agitator 356 preferably includes a pair of agitator blades 354 similar to blades 254 of agitator 156. The agitator blades are secured to the agitator by a fastening ring 358 and by a disk 366. Braces 378 and braces 368 provide additional agitation.

The agitator 356 may be made of any suitable, durable non chemically reactive material, for example, stainless steel. The disk 366 is connected to an agitator shaft 389. The agitator shaft is rotated in the direction of arrow 342 and at angular rotational speed ooxio of approximately 5 to 45 revolutions per minute. The agitator 356 is rotatably supported around agitator axis 316 by upper bearing 332. The bearing 332 is secured to hopper 12.

The tube 340 is preferably fixedly secured to cam support 387, while the cam support is slidably secured to agitator shaft 389. The agitator shaft is fixedly secured to agitator and rotates therewith. The tube 340 thus tends to rotate with the agitator 356. It should be appreciated that the powder dispenser 310 may be constructed such that the tube 340 does not rotate or rotates at a speed different from that of the agitator 365.

Preferably, to reduce the impact of hydrostatic pressure on the upper layer of the toner, the agitator 356 preferably also includes a feature, for example rings, for reducing hydrostatic pressure. The rings preferably include a bottom ring 364 connecting to element 365 and through it to disk 366. Extending upwardly from bottom ring 364 is top ring 370. Top ring 370 is connected to bottom ring 364 by braces 372. The rings 364 and 370 rotate with the agitator blades 354 and are connected thereto.

Figure 6:
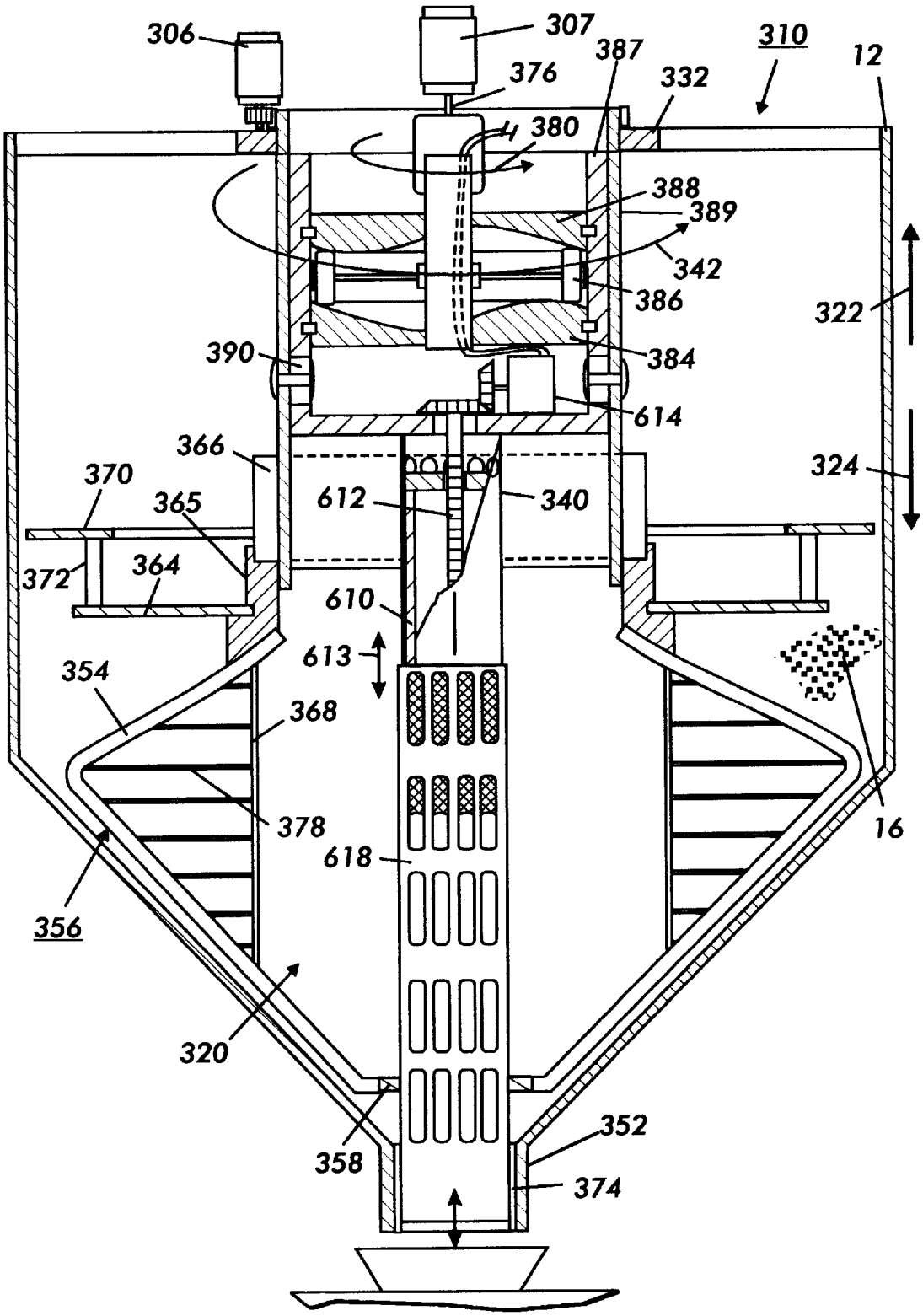
FIG. 6 is a cross-sectional schematic view of an embodiment representing an automatically controlled variable and continuous or intermittent feed apparatus of the present invention.

Referring to FIG. 6, there is shown a cross-sectional schematic view of an embodiment of the present invention representing an automatically controlled variable-continuous, or alternatively, an intermittent feed system wherein a vertically slidable cylinder 610 is attached to drive screw 612 which screw is attached to and driven by electric motor 614. The cylinder 610 can be driven or advanced within punched tube or cylinder 616 thereby controllably closing or opening predetermined discharge holes 617 in cylinder 616 and thereby continuously controlling the feed rate of powder therefrom.

Figure 7:
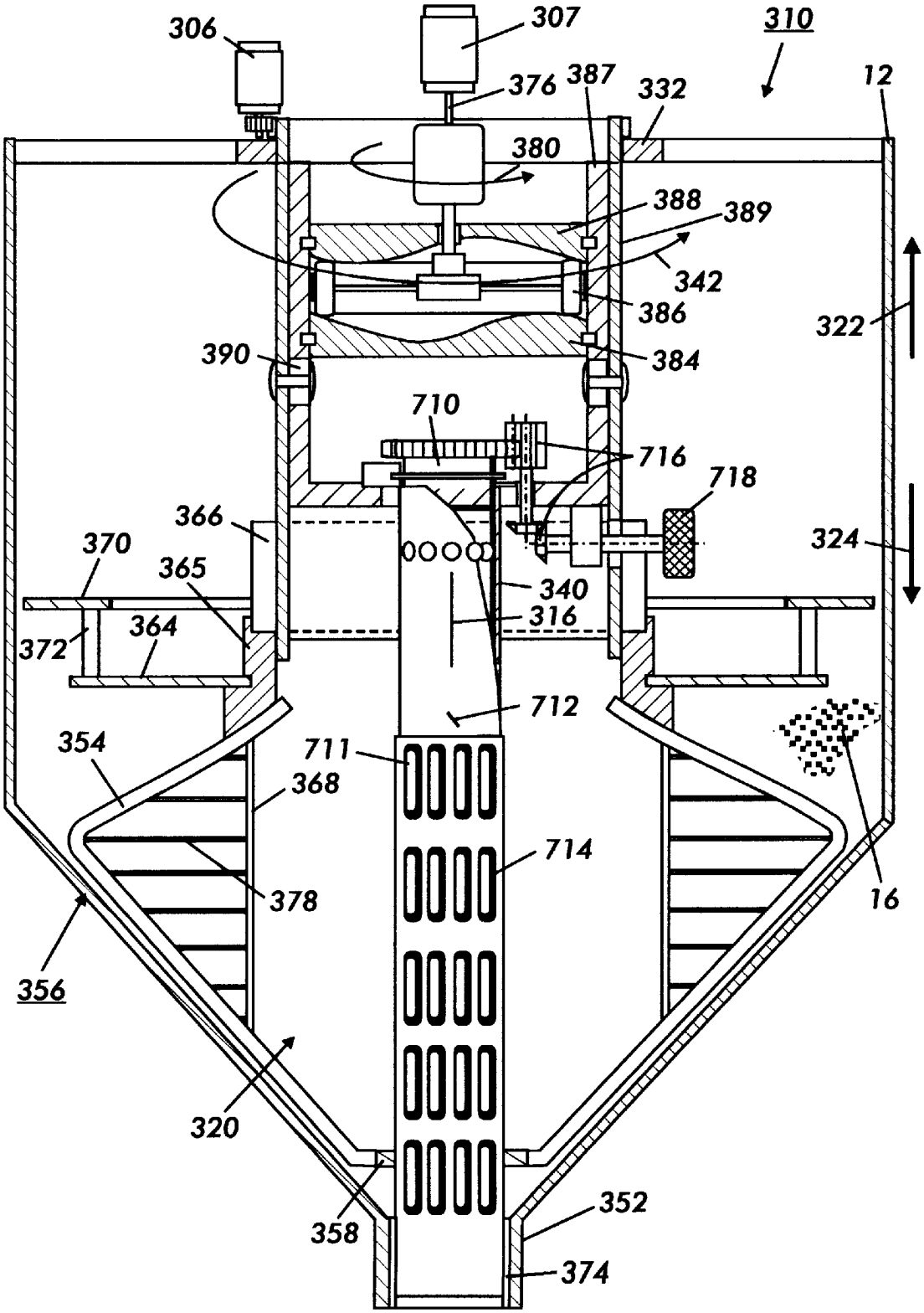
FIG. 7 is a cross-sectional schematic view of an embodiment representing a variable, manually or automatically preset, that is to discrete rate levels, feed rate apparatus of the present invention.

Referring to FIG. 7, there is shown a cross-sectional schematic view of an embodiment of the present invention representing a variable manually or automatically preset feed rate system wherein a thin walled coaxial cylinder 710 with vertical slots or apertures 711, which slots match those slots or apertures 714 in the outer punched tube or cylinder 712, is circularly rotatable within cylinder 712 so that slots or apertures 714 in cylinder 712 are controllably "gated" or reduced in size as desired. The size of the apertures or slots 714 in cylinder 712 can be controllably regulated by coaxially rotating and driving cylinder 710 within cylinder 712 by way of, for example, a manual or servo gear assembly 716 which assembly is readily adjusted or altered by external knob or gear connect 718 to preset positions with known and discrete output rates.

By providing a method for filling a toner container which includes the steps of directing the toner into toward an aperture such that toner clogs in the aperture and then to mechanically excite the toner and improve the flow properties of the toner so as to unclog the toner, enabling a simple, inexpensive, and accurate method for controlling the flow of toner into a container.

By providing a method for filling a toner container in which the flow of toner is metered by selectively mechanically exciting the toner within an aperture by subjecting the toner to a vibration source of about 10 to about 200 Hertz, a simple inexpensive toner filling method may be available.

By providing a toner filling method which includes the step of mechanically exciting the toner located around an aperture at the fill tube which accelerates the toner upward at least 32 feet per second squared, a simple, inexpensive, accurate toner flow control method can be provided.

By providing a toner filling method which includes subjecting the toner to an upward acceleration which increases the volume of the toner adjacent a small aperture of at least 10 percent, and preferably from about 10 to 100 percent, a simple inexpensive toner filling method may be provided.

By providing an apparatus for controlling the flow of toner including a member located within a hopper and a mechanical exciter for controlling, facilitating and blocking the flow of toner within the aperture(s), a simple, and inexpensive toner valve may be provided.

By providing a toner valve which includes a member having one or more apertures which member includes an acceleration of at least 32 feet per second square, a simple, inexpensive toner valve may be provided.

By providing a toner valve which includes a device for accelerating the toner with such acceleration as to increase the volume of the toner at least 10% around an aperture and selectively accelerating and decelerating the toner, a simple, reliable valve may be provided.

An adjustable valve for handling and dispensing particulate materials, such as electrostatographic developer material, has been described, for example, in controlling toner flow for filling toner containers or particulate material processing equipment such as an extruder. The method and apparatus allow particulate materials including toners to be dispensed, mixed, and transported more accurately and rapidly than prior art systems and can also insure that, for example, a melt mix apparatus or a toner container is filled accurately, quickly, cleanly, and in proper proportion.

Other modifications of the present invention may occur to those skilled in the art based upon a review of the present application and these modifications, including equivalents thereof, are intended to be included within the scope of the present invention.

What is claimed is:

1. A method comprising:

providing a particulate material source and receiver, and wherein said source contains a discharge feature;

moving material in the source and in the direction of said discharge feature, said discharge feature comprising a vertically oriented coaxial tubular member comprised of a first outer tube and second inner tube within said first outer tube is located at least partially within the source, said tubular member defining adjustable restrictions therein such that the particulate material clogs within the adjustable restrictions;

mechanically agitating the particulate material in the source with a co-rotatable mechanical agitator situated within said source, at least adjacent to the adjustable restrictions, to thereby unclog the particulate material within the adjustable restrictions; and dispensing particulate material through apertures formed by the adjustable restrictions, then through the discharge feature, and then into the receiver.

2. A method in accordance with claim 1, further comprising removing the receiver from the filling relationship with the source; and replacing with a second receiver in a filling relationship to the source in a continuous or semi-continuous sequence.

3. A method in accordance with claim 1, wherein the dispensing of the particulate material from the source is continuous.

4. A method in accordance with claim 1, wherein the dispensing of the particulate material from the source is a variable and discrete feed process and wherein the adjustable restriction fixes the size of apertures in the discharge feature.

5. A method in accordance with claim 4, wherein the receiver is an extruder, a classifier, a blender, a screener, a variable rate toner filler, or a melt mixing device for particulate toner or developer materials, and mixtures thereof.

6. A method in accordance with claim 4, wherein the receiver is a bottle, a cartridge, or container for particulate toner material or developer materials.

7. A method in accordance with claim 4, wherein said continuous and discrete/feed process provides an increase in output efficiency from about 200 to about 400 percent compared to a conventional auger filler.

8. A method in accordance with claim 1, wherein the dispensing of the particulate material from the source is a continuous and variable feed process and wherein the adjustable restriction varies the number of apertures in the discharge feature.

9. A method in accordance with claim 1, wherein the particulate material is a toner comprised of resin and colorant.

10. A method in accordance with claim 1, wherein the receiver is brought into the filling relationship with the source via a conveyor and elevator.

11. A method in accordance with claim 1, wherein the agitation of the particulate material provides in the source discharge feature a void volume of air between particles which is substantially constant and which void volume is from about 12 to about 15 percent of the total available volume.

12. A method in accordance with claim 1, wherein the step of mechanically agitating the particulate material comprises subjecting the particulate material in the source to a vibration source with a frequency of from about 10 Hertz to about 200 Hertz, and to an acceleration source for accelerating the particulate material to about 32.2 to about 64.4 feet/sec$^2$ in the vertical direction.

13. A method in accordance with claim 1, wherein dispensing the particulate material comprises directing flowing particulate material through a plurality of adjustable restrictions located at least partially within the source.

14. A method in accordance with claim 1, wherein dispensing the particulate material comprises dispensing the particulate material from the exterior of said tubular member and its adjustable restrictions, through the restrictions, and into the interior of said tubular member.

15. A method in accordance with claim 1, wherein the dispensing of the particulate material from the source into said discharge feature is an intermittent and variable feed process and wherein the adjustable restrictions vary the number of apertures in the discharge feature.

16. An apparatus comprising:

a vertically oriented coaxial tubular member operably associated with a hopper, said operably associated tubular member defining adjustable restrictions therein, wherein said adjustable restrictions can be optionally remotely and continuously adiusted without interrupting the operation of said apparatus; and a rotatable mechanical agitator internally situated within said hopper for controllably facilitating and blocking the flow of a particulate material through said adjustable restrictions, and through said apparatus, and wherein said agitator is in direct contact with said particulate material.

17. An apparatus in accordance with claim 16, wherein said mechanical agitator provides an acceleration to the material comprised of a powder, in a upward direction so as to increase the total volume of the powder and void volume by about 10 to about 100 percent.

18. An apparatus in accordance with claim 16, wherein said mechanical agitator provides an acceleration source for accelerating the powder from about 32.2 to about 64.4 feet/sec$^2$, wherein said mechanical agitator subjects the powder to a vibration motion with a frequency of from about 10 Hertz to about 200 Hertz.

19. An apparatus in accordance with claim 16, wherein said vertically oriented coaxial tubular member comprises a first tube defining a plurality of apertures in the periphery thereof and a axially rotatable coaxial second tube defining a plurality of apertures in the periphery thereof, wherein said second tube resides within said first tube, and wherein the adjustable restrictions are of the form of a plurality of variable size apertures arising from varying the relative rotational coaxial relationship of said first tube and said coaxial second tube.

20. An apparatus in accordance with claim 16, wherein said vertically oriented coaxial tubular member comprises a first tube defining a plurality of apertures in the periphery thereof and a coaxial second tube free of apertures in the periphery thereof, wherein said second tube resides within said first tube, and wherein the adjustable restrictions are of the form of a variable number of apertures in said first tube arising from varying the relative slidable coaxial displacement relationship of said first tube and said coaxial second tube.

* * * * *